US009388593B2

(12) United States Patent
McKain et al.

(10) Patent No.: US 9,388,593 B2
(45) Date of Patent: Jul. 12, 2016

(54) SAFETY DEVICE FOR DRAIN SUMP

(76) Inventors: Paul Crandall McKain, Tallahassee, FL (US); Fallon Leigh McKain, Tallahassee, FL (US)

( * ) Notice: Subject to any disclaimer, the term of this patent is extended or adjusted under 35 U.S.C. 154(b) by 889 days.

(21) Appl. No.: 13/590,409

(22) Filed: Aug. 21, 2012

(65) Prior Publication Data

US 2013/0205490 A1 Aug. 15, 2013

Related U.S. Application Data

(60) Provisional application No. 61/597,437, filed on Feb. 10, 2012, provisional application No. 61/600,590, filed on Feb. 18, 2012, provisional application No. 61/613,502, filed on Mar. 21, 2012, provisional application No. 61/641,960, filed on May 3, 2012.

(51) Int. Cl.

| | |
|---|---|
| ***E04H 4/00*** | (2006.01) |
| ***E04H 4/12*** | (2006.01) |
| *E03F 5/04* | (2006.01) |

(52) U.S. Cl.

CPC ..... *E04H 4/1218* (2013.01); *E03F 5/041* (2013.01)

(58) Field of Classification Search

USPC ..... 4/509, 504, 507; 210/167.15, 167.16

See application file for complete search history.

(56) References Cited

U.S. PATENT DOCUMENTS

| | | | | |
|---|---|---|---|---|
| 6,592,341 | B1 * | 7/2003 | Olney | 417/313 |
| 6,760,931 | B1 * | 7/2004 | Mattson et al. | 4/541.1 |
| 2007/0039095 | A1 * | 2/2007 | Lawson | 4/507 |

* cited by examiner

*Primary Examiner* — Lauren Crane

(74) *Attorney, Agent, or Firm* — Robert M. Downey, P.A.

(57) ABSTRACT

A safety device for a drain sump includes a drain adjunct member and an adapter for attaching the drain adjunct member to the main drain pipe that is in connection with the pool or spa pump. The drain adjunct member is "T-shaped" for limiting the possibility of limb entrapment and further includes anti-hair entangling mesh and vacuum relief holes for limiting the possibility of hair and body entrapment. In the event that an individual does block water flow into the drain adjunct member, the unblocked vacuum relief holes prevent a vacuum force from being created by allowing increased intake of water therethrough. The arrangement of the vacuum relief holes on the body of the drain adjunct member disrupts the vortex effect otherwise created by the typical single direction flow of water in a standard main drain pipe, thereby further limiting the likelihood of limb, body or hair entrapment.

5 Claims, 6 Drawing Sheets

SAFETY DEVICE FOR DRAIN SUMP

This application claims the benefit of U.S. Provisional Patent Application Ser. Nos. 61/597,437 filed on Feb. 10, 2012, 61/600,590 filed on Feb. 18, 2012, 61/613,502 filed on Mar. 21, 2012 and 61/641,960 filed on May 3, 2012.

BACKGROUND OF THE INVENTION

1. Field of the Invention

The present invention relates to drain sumps and, more particularly, to a safety device for a drain sump that is structured to prevent an individual or object from obstructing the flow of water entering the opening of a drain pipe in communication with a pool pump.

2. Discussion of the Related Art

Generally, one or two main drains are included on a swimming pool's floor or side wall as part of the swimming pool circulation system, which drains and filters pool water prior to directing the water back into the swimming pool. A drain sump at the swimming pool floor is in communication with the main drain and includes a drain grate for blocking access to the drain sump. The primary force in draining the pool water is the suction produced by the pool pump, which pulls water from the swimming pool into the main drain(s). The considerably high amount of suction produced by the pool pump has resulted in a number of accidents involving individuals swimming in the vicinity of the drain sump being trapped against the drain grate, creating a vacuum within the main drain between the obstruction and the pool pump, which can result in serious injury and/or death by drowning. In cases where the drain grate is damaged or missing, the visible opening creates an attractive nuisance to children who are likely to inspect the exposed drain sump and possibly get their arm or leg caught in the drain pipe, making it extremely difficult to pry the child to safety. There are five common types of entrapment include (1) limb entrapment, wherein a portion of an individual's limb gets pulled into the sump or skimmer orifice; (2) mechanical entrapment, wherein a user's entrapped limb undergoes edema or swelling due to the intense vacuum force; (3) hair entrapment, wherein an individual's hair gets tangled around the drain cover (4) body entrapment, wherein an individual covers the entire opening of the drain or skimmer and the vacuum force from the pump creates the entrapment; and (5) evisceration, wherein an individual, usually a child, sits on the drain creating a blockage where the intense vacuum force pulls the intestines out of the body and through the piping system.

In order to combat this issue, a number of attempts have been directed towards improving the design of the main drain and drain sump. One example of such an attempt is provided in U.S. Pat. No. 7,455,070 to Hamza, which discloses a vacuum relief safety valve attached to a pool pump and having an air inlet aperture exposed to ambient air and a sealing element which is pressed against the aperture by a spring. In the event that the maximum allowed vacuum level in the pump is exceeded, the sealing element moves into the inner chamber and opens the air inlet aperture, causing the pump to lose its prime. The '070 patent, while useful for its intended purpose, does not provide adequate assurance of an entrapped swimmer's escape due to the requirement that the obstructing object or swimmer must actually create a vacuum force in to trigger the maximum vacuum level and open the air inlet valve. The '070 patent and others fail to provide a simple and effective design for preventing entrapment of a swimmer within a drain sump.

Therefore, there remains a need for a safety device for drain sumps that prevents an individual from being entrapped by the suction force produced by a pool pump in the event that a person obstructs the flow of water through the main drain pipe in connection with the pool pump, thereby allowing the person to safely escape entrapment.

Objects And Advantages Of The Invention

Considering the foregoing, it is a primary object of the present invention to provide a safety device for a drain sump that can be retrofitted to an existing drain sump.

It is a further object of the present invention to provide a safety device for a drain sump that prevents limb and mechanical entrapment, hair entanglement and body entrapment on the device, and further mitigates the effects of evisceration.

It is a further object of the present invention to provide a safety device for a drain sump that is not readily and easily removable by an individual unfamiliar with the safety device.

It is a further object of the present invention to provide a safety device for a drain sump that can be easily manufactured.

These and other objects and advantages of the present invention are readily apparent with reference to the detailed description and accompanying drawings.

SUMMARY OF THE INVENTION

The present invention is directed to a safety device for a drain sump including a drain adjunct member and an adapter for attaching the drain adjunct member to the drain pipe that is in connection with the pool or spa pump. The drain adjunct member is "T-shaped" for limiting the possibility of limb entrapment and further includes anti-hair entangling mesh and vacuum relief holes for limiting the possibility of hair and body entrapment. In the event that an individual does manage to partially insert a limb into the drain adjunct member or otherwise block water flow into the drain adjunct member, the vacuum relief holes prevent a vacuum force from being created by allowing increased intake of water therethrough. The arrangement of the vacuum relief holes on the body of the drain adjunct member disrupts the vortex effect otherwise created by the typical single direction flow of water in a standard main drain pipe, thereby further limiting the likelihood body or hair entrapment when the drain cover is in place and eliminating the likelihood of limb, mechanical and hair entanglement when the drain cover is missing, and mitigating the effects of an evisceration.

The drain adjunct member is connected to the main drain pipe by connecting the attachment adapter to the main drain pipe, leaving an attachment ridge exposed along the perimeter of the main drain pipe opening. The drain adjunct member is sized and structured for secured attachment to the attachment ridge.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
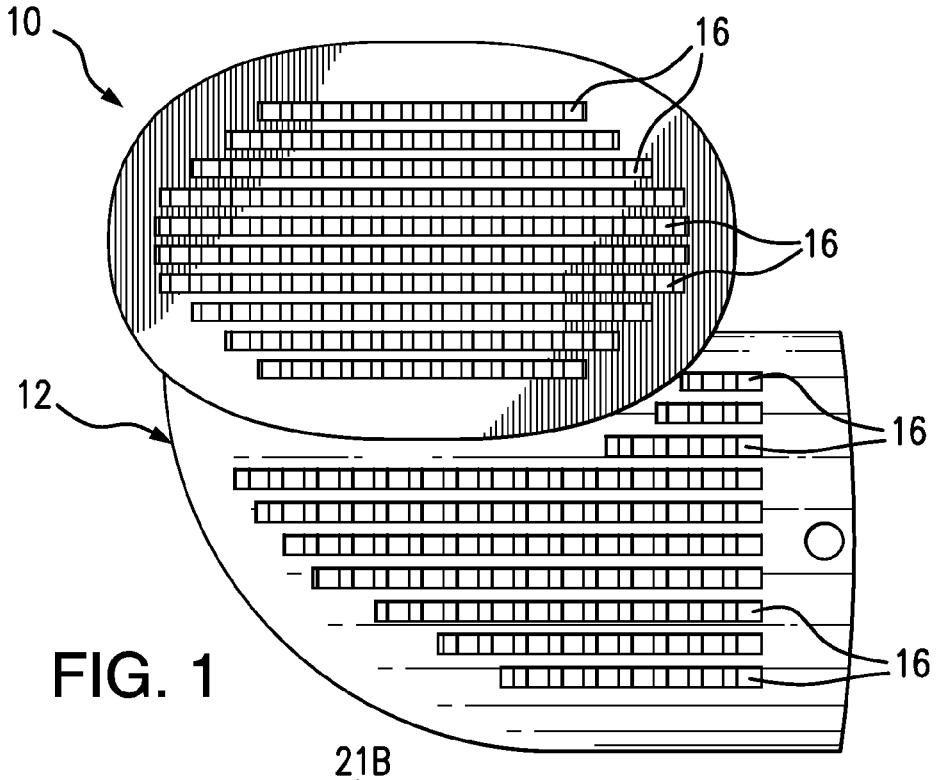
FIG. 1 is a front side view illustrating the safety device for a drain sump of the present invention.

Referring to the several views of the drawings, the safety device for a drain sump of the present invention is shown in accordance with several preferred embodiments and provided for installation within the drain sump 100 of a swimming pool or spa. In each of the drawing figures, the safety device is generally indicated as 10.

Figure 2:
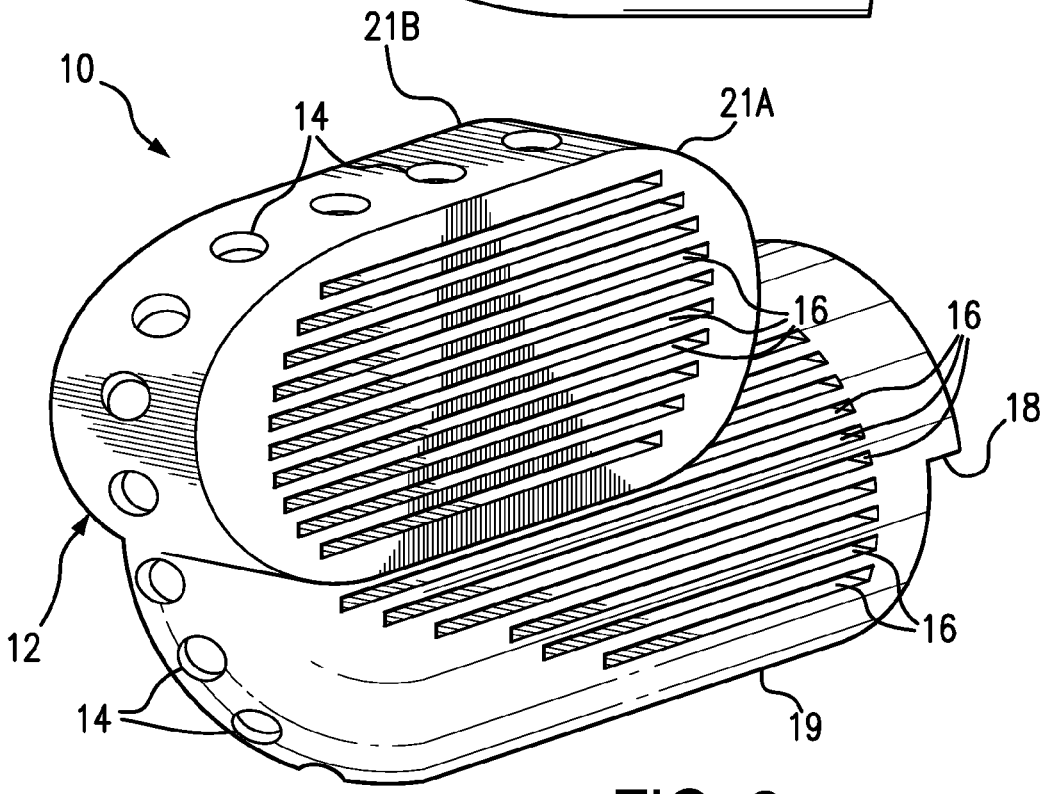
FIG. 2 is a back side perspective view illustrating the drain sump of the present invention.
Figure 2A:
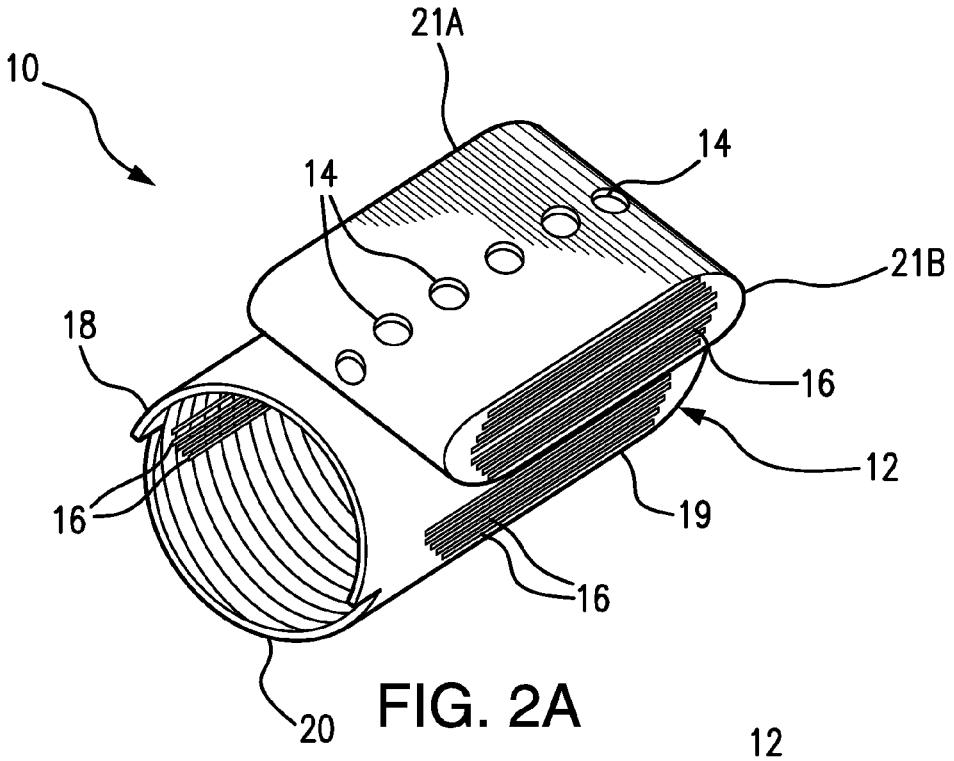
FIG. 2A is a top side perspective view illustrating the drain sump of the present invention.
Figure 2B:
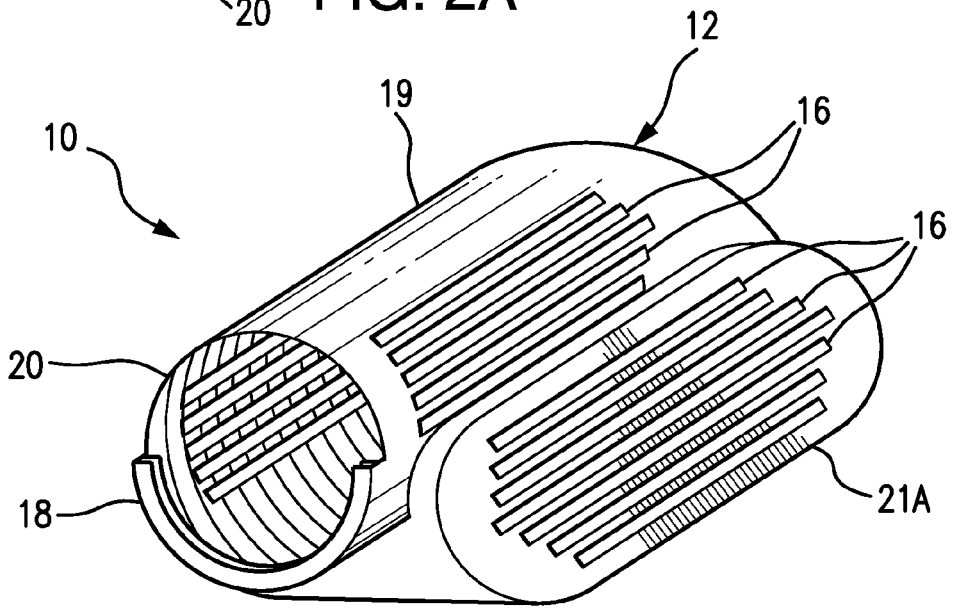
FIG. 2B is a bottom side perspective view illustrating the drain sump of the present invention.
Figure 3:
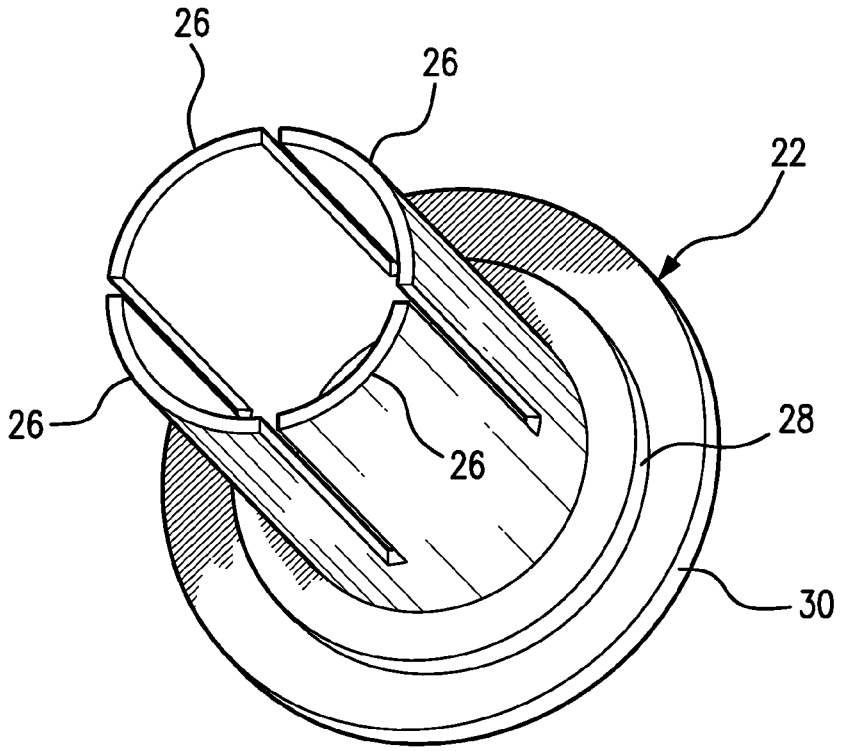
FIG. 3 is a perspective view illustrating attachment adapter.

Referring initially to FIGS. 1-3, the safety device 10 includes a "T" shaped drain adjunct member 12 having vacuum relief holes 14, anti-hair entangling mesh 16, and a semi-annular receiving rim 18 partially surrounding an attachment opening 20. As shown in FIGS. 1-2B, the drain adjunct member 12 includes opposing orifices 21A and 21B extending outwards from a main body 19. Preferably each orifice 21A and 21B is at least partially covered in anti-hair entangling mesh 16. The "T" shaped drain adjunct member 12 is predominantly hollow, forming a water flow passage 23 between the attachment opening 20 and the multiple water inlets (vacuum relief holes 14 and anti-hair entangling mesh 16) to produce a directional flow of water therethrough into a main drain pipe 24.

Referring specifically to FIGS. 2-2B, the vacuum relief holes 14 extend along the top side and back side of the drain adjunct member 12. The arrangement of the vacuum relief holes 14 prevents a vortex from forming by pulling water from several different locations through the drain adjunct member 12 and into the drain adjunct member 12, thereby disrupting the flow pattern of the water being pulled into the main drain pipe 24. While the vacuum relief holes 14 illustrated in the Figures are arranged in single file order along the center line of the top side and back side of the drain adjunct member 12, the relief holes 14 may be arranged in any manner suitable for preventing the vortex effect upon entering the water flow passage 23 of the drain adjunct member 12. In a preferred embodiment, the vacuum relief holes 14 are sized to allow entry of debris that enters the drain sump 100, thereby allowing the debris to passively pass through the main drain pipe 24 and filtration system for removal by the pool or spa filter.

The anti-hair entangling mesh 16 is provided to prevent entrapment by hair entanglement and further serves as an additional inlet for water to enter the water flow passage 23 of the drain adjunct member 12 for further disrupting the water flow pattern. An example of a suitable anti-hair entanglement mesh 16 is disclosed in U.S. Pat. No. 6,393,631 to Schroader. As shown in the Figures, the anti-hair entangling mesh 16 is included on orifices 21A and 21B as well as the front and back sides of the main body 19 of the drain adjunct member 12.

Figure 9:
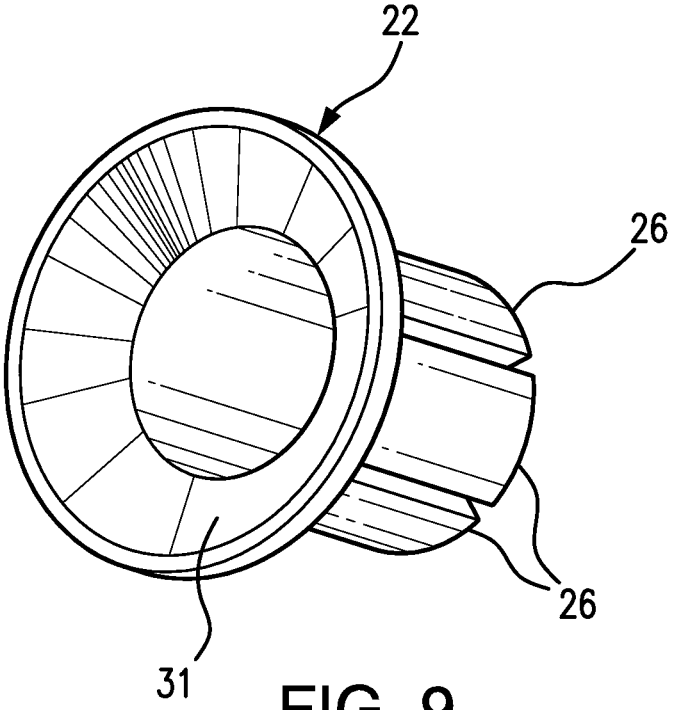
FIG. 9 is a perspective view illustrating the opening of the adapter.

Referring to FIG. 3, an attachment adapter 22 is provided for securing the drain adjunct member 12 to the main drain pipe 24, which is in connection with the pool or spa pump. The attachment adapter 22 includes prongs 26 extending from the main body of the adapter 22 sized for fitted insertion within a main drain pipe 24. When the prongs 26 are fully inserted within the main drain pipe 24, a first annular rim 28 that is sized larger than the opening of the main drain pipe 24 comes into abutment against the opening of the main drain pipe 24, leaving a second annular rim 30, which is sized larger than the first annular rim 28, exposed. The second annular rim 30 is provided for attachment to the drain adjunct member 12, wherein the semi-annular receiving rim 18 on the drain adjunct member 12 is sized to receive the second annular rim 30 for secured attachment thereto. The design of the adapter 22 reduces fluid turbulence and creates a laminar flow which results in a parabolic effect within the piping. In particular, as shown in the embodiment of FIG. 9, the funnel-shaped entry 31 of the adapter 22 leading to the adapter interior serves to direct the water in a laminar flow with less turbulence. This effect, in turn, streamlines the flow of water into the main drain pipe 24, resulting in less power required to run the pool or spa filtration system. The design of the adapter 22 that structures the laminar flow can be applied to skimmers as well as various locations within the piping system to continue the structured flow. This in turn will decrease the work load on the pump and increase water flow thereby saving energy by decreasing the pump's work load and limiting the time that the pump needs to run to accomplish the necessary water turnover.

A problem that exists in pools today is that a bather can put their limbs into the skimmer vacuum orifice and have said limb pulled into the piping creating an entrapment. Although the bather is above water level, the pool piping frequently needs to be removed from the pool decking in order to extricate the limb. Installing an adapter 22 in a skimmer not only improves the flow rate and increases the debris removal by increasing the flow rate, but it also acts as a safety device. Should a bather have their limb pulled into the adapter 22 located in the skimmer return orifice, the bather may simply pull back from the vacuum force, thereby pulling the adapter 22 and the limb from the skimmer return orifice and eliminating the entrapment.

Figure 4:
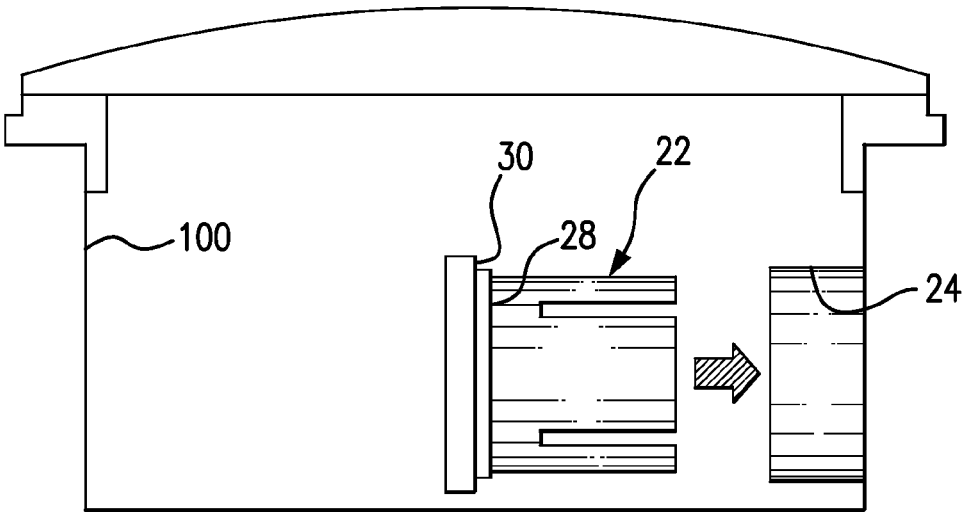
FIG. 4 is an isolated side plane view, shown in cross-section, illustrating the insertion of the attachment adapter into the opening of a main drain pipe.
Figure 5:
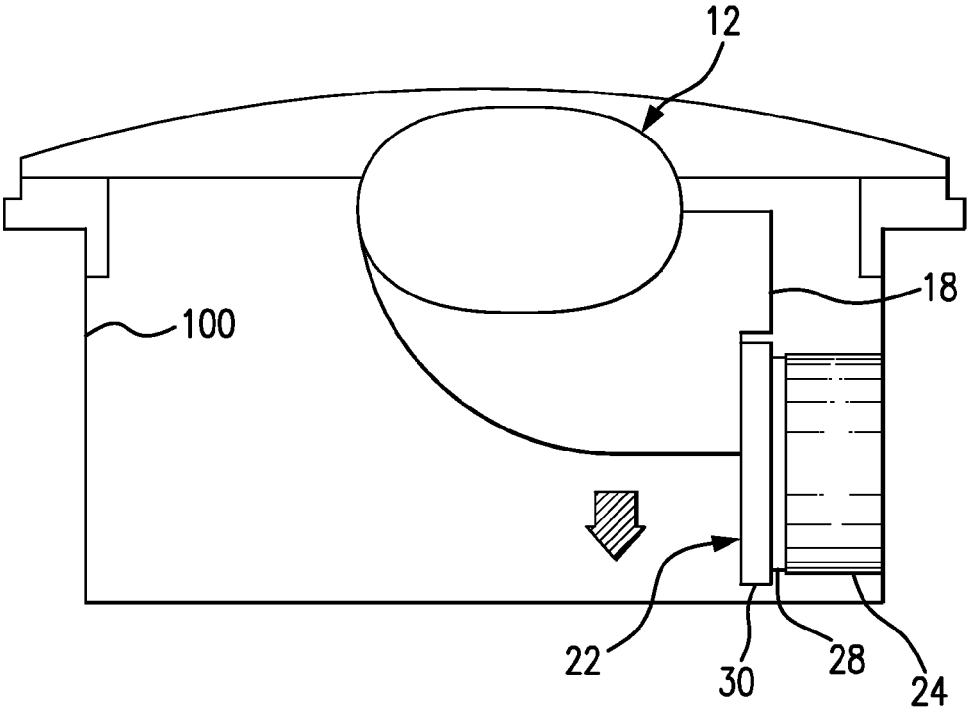
FIG. 5 is an isolated side plane view, shown in cross-section, illustrating the attachment of the safety device for a drain sump of the present invention to the attachment ridge of the attachment adapter.
Figure 6:
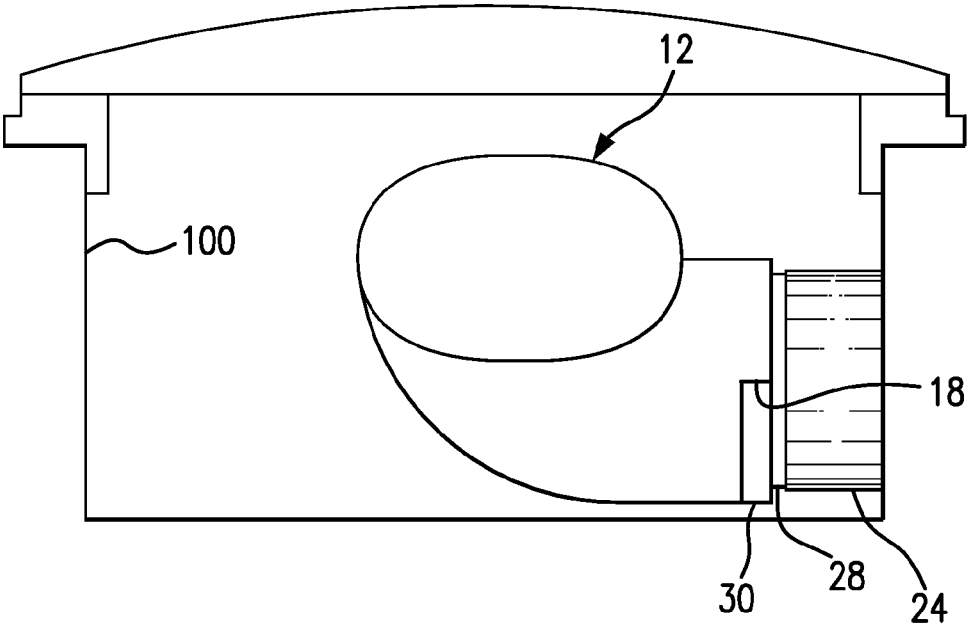
FIG. 6 is an isolated side plane view, shown in cross-section, illustrating the safety device for a drain sump of the present invention secured to a main drain pipe.

Referring to FIGS. 4-6, installation of the safety device 10 requires securing the attachment adapter 22 to the main drain pipe 24 by inserting prongs 26 of the adapter 22 into the opening of the main drain pipe 24 and pushing until the first annular rim 28 comes into contact with the opening of the main drain pipe 24. The drain adjunct member 12 may then be secured to the attachment adapter 22 by fitting the second annular rim 30 within the semi-annular receiving rim 18.

Figure 7:
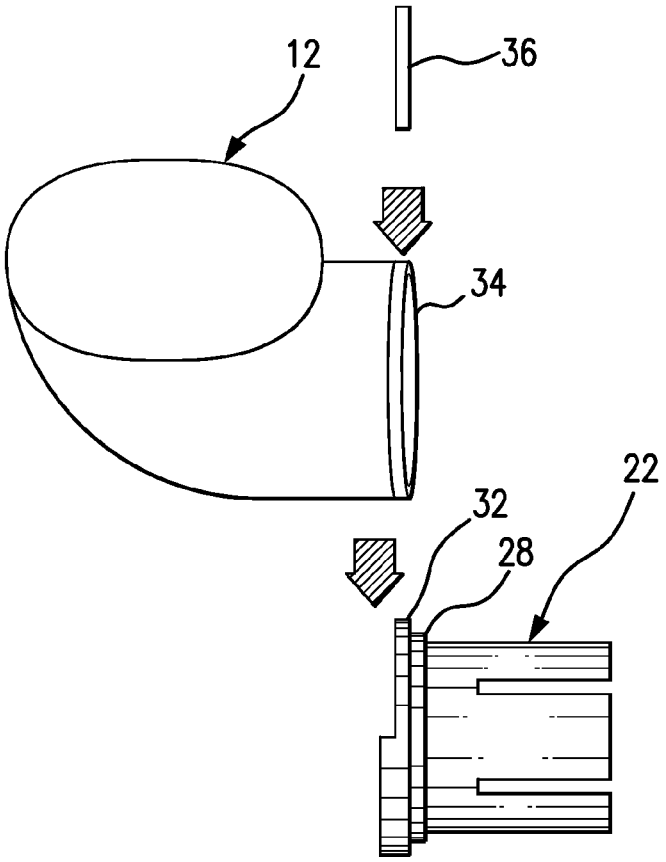
FIG. 7 is a front side view illustrating alternative embodiments of the front opening of the attachment adapter and the attachment opening on the drain adjunct member.
Figure 8:
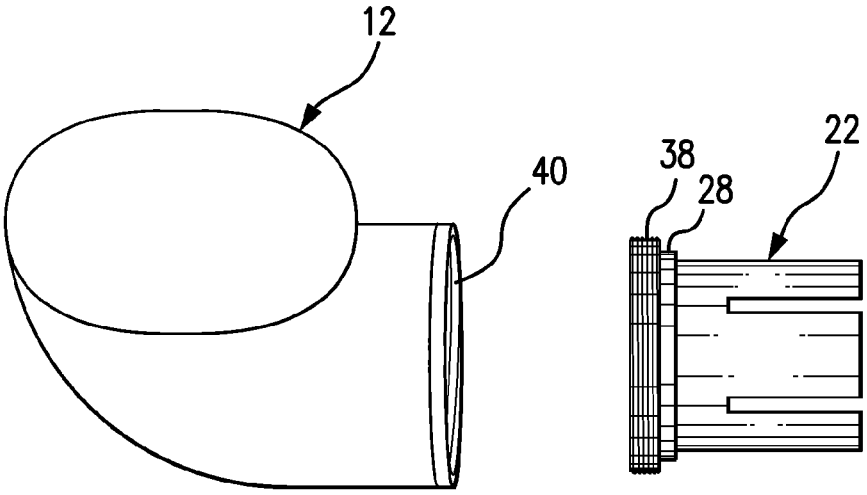
FIG. 8 is a front side view illustrating alternative embodiments of the front opening of the attachment adapter and the attachment opening on the drain adjunct member.

Referring to FIGS. 7 and 8, alternative methods of attaching the drain adjunct member 12 to the attachment adapter 22 are shown. FIG. 7 illustrates an alternative embodiment of the attachment adapter 22 including a semi-annular receiving cradle 32 for receiving an annular rim 34 on the opening 20 of the drain adjunct member 12. A semi-annular locking member 36 is sized and configured to attach with the semi-annular receiving cradle 32, thereby securing the annular rim 34 in sealed engagement. FIG. 8 illustrates another alternative embodiment of the second annular rim 30 on the attachment adapter 22 wherein a threaded outer rim 38 is sized to receive the threaded inner rim 40 of an alternative of embodiment of the drain adjunct member 12 in sealed engagement.

The "T" section of the drain adjunct member 12 may be angled upwards (greater than 90 degrees) to allow any hair that somehow wraps around the drain adjunct member 12 to slide free by pulling upwards, which is the natural movement of an individual who feels trapped beneath the water surface.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. A safety device for use with a swimming pool or spa having a main drain pipe, said safety device comprising:

a drain adjunct member defined by a unitary body having a bottom, a front end, a back end, a top, opposite facing sides including a first side and a second side, and the unitary body including a plurality of vacuum relief holes formed through at least the front end and the top, and an attachment opening at the back end;

said drain adjunct member further including anti-hair entangling mesh on the first side of the unitary body and on the opposite facing second side of the unitary body, and a water flow passage extending between the attachment opening and said plurality of vacuum relief holes and the anti-hair entangling mesh for directional flow of water therethrough;

an attachment adapter having a front opening and a rear opening for directional flow of water therethrough, said front opening being adaptable for engagement to the attachment opening of said drain adjunct member in fluid flow connection therewith, and said rear opening being adaptable for engagement to the main drain pipe in fluid flow communication therewith; and whereby suction from a pool pump in communication with said main drain pipe causes water to enter the water flow passage of said drain adjunct member at said plurality of vacuum relief holes and the anti-hair entangling mesh on the opposite first and second sides and exit at said attachment opening into the main drain pipe, and whereby water flowing through said water flow passage of said drain adjunct member does not produce a vortex effect.

2. The safety device as recited in claim 1 wherein said vacuum relief holes are sized and structured for allowing passage of debris therethrough.

3. The safety device as recited in claim 1 wherein said attachment adapter includes a plurality of prongs extending from the rear opening of said attachment adapter, and said plurality of prongs being structured and disposed for engaging the main drain pipe when fully inserted therein.

4. The safety device as recited in claim 1 wherein said attachment adapter includes an annular rim extending from the front opening of said attachment adapter, and said annular rim having a larger diameter than the front opening.

5. The safety device as recited in claim 4 wherein said drain adjunct member includes a semi-annular receiving cradle partially surrounding the attachment opening of said drain adjunct member, and being structured and disposed for receiving said annular rim to form a sealed engagement between said drain adjunct member and said attachment adapter.

* * * * *